US010188224B2

(12) United States Patent
Fischer

(10) Patent No.: US 10,188,224 B2
(45) Date of Patent: Jan. 29, 2019

(54) REFRIGERATED CASE WITH A SELF-CONTAINED CONDENSATE REMOVAL SYSTEM AND LEAK DETECTION

(71) Applicant: Killion Industries, Inc., Vista, CA (US)

(72) Inventor: Karl Fischer, Carlsbad, CA (US)

(73) Assignee: Killion Industries, Inc., Vista, CA (US)

( * ) Notice: Subject to any disclaimer, the term of this patent is extended or adjusted under 35 U.S.C. 154(b) by 215 days.

(21) Appl. No.: 15/060,461

(22) Filed: Mar. 3, 2016

(65) Prior Publication Data

US 2017/0020305 A1 Jan. 26, 2017

Related U.S. Application Data

(60) Provisional application No. 62/127,400, filed on Mar. 3, 2015.

(51) Int. Cl.
*A47F 3/04* (2006.01)
*F25D 21/14* (2006.01)

(52) U.S. Cl.
CPC ..... *A47F 3/0478* (2013.01); *A47F 3/0443* (2013.01); *A47F 3/0469* (2013.01); (Continued)

(58) Field of Classification Search
CPC .... A47F 3/0478; A47F 3/0469; A47F 3/0443; A47F 3/0482; F25D 21/14; (Continued)

(56) References Cited

U.S. PATENT DOCUMENTS 3,759,059 A * 9/1973 Kenyon ..... A47F 3/0482 62/246
4,608,835 A * 9/1986 Kooy ..... A47F 3/0443 62/255

(Continued)

FOREIGN PATENT DOCUMENTS

CA 2621045 A1 8/2008
DE 102011085155 A1 4/2013

(Continued)

OTHER PUBLICATIONS

JP2005098627A ENG Translation.*

*Primary Examiner* — Nelson Nieves
(74) *Attorney, Agent, or Firm* — Gary L. Eastman, Esq.; Eastman & McCartney LLP

(57) ABSTRACT

A preferred embodiment utilizes the waste heat from a refrigerant cycle to aid in the removal of condensate from a refrigerated case used primarily by grocery stores. Certain embodiments use a heating element to boil off condensate or a pump to remove the condensate. Another embodiment utilizes a wicking element and a shroud that directs hot air from the condenser through the wick thereby increasing the condensate evaporation rate. Yet another embodiment utilizes the hot gas tube from the refrigeration system routed through the bottom of the condensate tray to pre-heat the condensate to accelerate evaporation. Alternative embodiments combine certain features to create even more efficient system such as a heating element used with the wick system or the hot gas system used with the wick system. In some embodiments, a mold and mildew inhibitor is added to the condensate to maintain cleanliness.

10 Claims, 12 Drawing Sheets

(52) U.S. Cl.
CPC ..... *A47F 3/0482* (2013.01); *F25D 21/14* (2013.01); *F25D 2321/1412* (2013.01); *F25D 2321/1413* (2013.01)

(58) Field of Classification Search
CPC ..... F25D 2321/1412; F25D 2321/1413; F25D 2321/143; F25D 2321/1441; F25D 2321/145
See application file for complete search history.

(56) References Cited

U.S. PATENT DOCUMENTS 5,678,421 A * 10/1997 Maynard ..... A47F 3/0408 62/279
6,487,867 B1 12/2002 Herren
8,539,783 B1 9/2013 Bunch
9,327,874 B2 * 5/2016 Hawley, III ..... B65D 25/38
2003/0121275 A1 * 7/2003 Erisgen ..... A47F 3/0482 62/246
2005/0217297 A1 * 10/2005 Wilson ..... A47F 3/0443 62/255
2005/0229614 A1 * 10/2005 Ansted ..... A47F 3/0482 62/150
2007/0000273 A1 * 1/2007 Sanders ..... F25D 21/14 62/285
2008/0115920 A1 * 5/2008 Uchida ..... A47F 3/0443 165/179
2008/0256974 A1 * 10/2008 Verma ..... F25B 9/008 62/498
2008/0283440 A1 * 11/2008 Hartsfield, Jr. ..... A47F 10/06 206/557
2009/0077992 A1 * 3/2009 Anderson ..... B01D 1/02 62/291
2010/0058787 A1 * 3/2010 Iguchi ..... A47F 3/0482 62/246
2010/0058788 A1 * 3/2010 Iguchi ..... A47F 3/0482 62/246
2010/0281896 A1 * 11/2010 Al Watban ..... F24F 5/0035 62/160
2012/0023983 A1 * 2/2012 Glaros ..... A47F 3/0482 62/125
2012/0303311 A1 * 11/2012 Rowe, Jr. ..... F04B 49/065 702/130
2012/0324914 A1 12/2012 Bartoletto
2013/0098091 A1 * 4/2013 Stephens ..... A47F 3/0482 62/247
2013/0125575 A1 * 5/2013 Szprengiel ..... F25D 21/08 62/275
2013/0160475 A1 * 6/2013 Vinz ..... A47F 3/0447 62/247
2014/0096545 A1 * 4/2014 Zangari ..... A47F 3/0478 62/80
2014/0341710 A1 * 11/2014 Creamer ..... F04D 29/063 415/111
2015/0245721 A1 * 9/2015 Nugroho ..... A47F 3/0482 62/256
2015/0330699 A1 * 11/2015 Hawley, III ..... B65D 25/38 220/571
2015/0342371 A1 * 12/2015 Leong ..... F25D 21/14 62/247
2015/0374143 A1 * 12/2015 Takayama ..... F25B 5/02 62/228.1
2015/0376874 A1 * 12/2015 Breedlove ..... E03B 7/071 137/2

FOREIGN PATENT DOCUMENTS

EP 2373200 B1 5/2012
GB 2198220 A 6/1988
JP 2005098627 A 4/2005
JP 2005274088 A 10/2005

* cited by examiner

REFRIGERATED CASE WITH A SELF-CONTAINED CONDENSATE REMOVAL SYSTEM AND LEAK DETECTION

RELATED APPLICATIONS

The application claims the benefit of priority to U.S. Provisional Patent Application Ser. No. 62/127,400 entitled "Energy Efficient Refrigeration System", filed on Mar. 3, 2015, and currently co-pending.

FIELD OF THE INVENTION

The present invention pertains generally to efficient refrigeration systems for use in grocery stores and cold food storage. More particularly, the present invention pertains to an efficient method of removing condensate that collects during operation by utilizing waste heat and airflow generated by the refrigeration system. The Present invention is particularly, but not exclusively, useful as a way to reduce energy consumption of portable or self-contained refrigeration units.

BACKGROUND OF THE INVENTION

Supermarket departments are typically designed and setup with remote refrigeration systems where remote refrigerated cases such as wall units and islands are installed with and controlled by central compressor banks/condensing units typically located in a back room or outside the building. In this type of installation, the condensate, which is water that condenses on the cooling coils then drips off, is drained into floor drains through permanently installed plumbing.

In some situations, it is desirable for the refrigerated cases to be of the self-contained design where the entire refrigeration system is contained within the refrigerator itself. Self-contained units may be used for adding additional refrigeration into store areas not originally designed in the store refrigeration system, for temporary or seasonal use, or for ease and low cost of department reconfiguring. Self-contained refrigerators may be permanently affixed to the floor or may be mobile thought the use of wheels or casters.

Removing condensate is of special concern where a floor drain and accompanying plumbing is not a viable option. In this situation, there are three options that are commonly used. The first is where condensate is eliminated by collecting and boiling it off in a pan having a heating element. The high electrical current draw of the heating element requires additional electrical service to the refrigerator, either by a significantly higher amperage circuit or the addition of another electrical circuit. The second option is to use the hot gas side of the refrigeration system and create a loop or coil that is immersed in a condensate collection pan. This option does not work as well as the heater pan since the condensate is often produced at a faster rate than the hot gas loop is able to remove under normal relative humidity conditions. In this case, excess condensate must be drained manually from the refrigerator. The third option requires periodic manual draining of the refrigerator.

Recently, the Department of Energy (DOE) started to implement their 2012 Energy Conservation Program, which regulates commercial refrigeration equipment. Its rules are mandatory for all manufacturers selling equipment in the United States. The program mandates maximum energy consumption dependent on the type model of the equipment.

The traditional method of boiling away the condensate through the use of a heating element typically consumes more than one third of the total energy consumption requirement of prior generation refrigerators. Full-time electric heaters to boil off the condensate are no longer a viable method in terms of meeting energy consumption requirements. In response to this program, commercial manufacturers have started to address energy usage in their designs to meet the DOE 2012 program requirements.

What is now needed in the industry is a high efficiency refrigeration system that does not require periodic manual draining or emptying and does not require the additional electrical current load to support operation of a heating element thereby reducing the system's power consumption.

SUMMARY OF THE INVENTION

A condensate collection pan made sufficiently large enough to hold all of the condensate expected to be generated during operation of the refrigeration system at any given time is designed to accommodate an electric heating element, a hot gas loop, coil, or other configuration of hot gas tubing from the refrigeration system employed, and a limit switch controlled by a liquid level float or other liquid level sensing switch that turns the heating element on and off. Further, the refrigeration system defrost timer is wired so that when the condensing unit is turned off for the defrost cycle the heating element is turned on for the duration of the defrost cycle. In addition to this, the temperature controller that regulates the on-off durations of the condensing unit during the cooling cycle is also wired so that when the condensing unit is turned off for case temperature regulation, the heating element is simultaneously turned on for the same duration. In certain embodiments, the condensing unit fan is wired to continuously run so that steam generated from boiling off the condensate is removed from the refrigerator's interior. Because the high electrical current draw of the compressor is alternating with the high electrical current draw of the heating element, no additional electrical service is required for the heating element. In other embodiments, the hot gas loop from the refrigeration system is used to preheat the condensate to assist the electric heating element in order to shorten the amount of time it takes to heat the condensate to point of evaporation.

During operation of a typical system, the defrost time duration would not be long enough for the heater to eliminate the condensate faster than it is produced during normal cooling operation. Typically, the cooling cycle lasts for 4-6 hours and the defrost cycle lasts for 15 minutes. The time it takes for the water to be raised from room temperature to the point of evaporation is too long resulting in condensate remaining in the pan after the defrost cycle has ended. The hot gas loop of the present invention preheats the condensate temperature to between 150 and 200 degrees F. This results in a shortened amount of time required to evaporate the condensate verses the majority of the defrost time being utilized to bring the condensate to the point of bong only to have the defrost cycle end with condensate remaining in the condensate tray.

Additions to the refrigeration systems may be computerized controls that receive inputs from various sensors that determine optimal on and off frequency and duration of the defrost cycle as well as control of the condensate removal system thereby further improving the energy efficiency of the system. In some embodiments, the computerized control further comprises an Early Leak Detection (ELD) system. The ELD utilizes one or more sensors configured to monitor and report the level of condensate in the condensate pan. If the sensors indicate the condensate level in the condensate pan is too high, the ELD sends a signal to the computerized control, which in turn shuts down the compressor, energizes or keeps energized the condenser fan and any condensate pan heaters, energizes audible and visual indicators, and sends a signal to a central monitoring and control system. In other embodiments, the ELD system is implemented without the use of computerized control but still is configured to shut down the compressor, energize or keep energized the condenser fan and any condensate pan heaters, and energize audible and visual indicators. Once the condensate removal system has brought the condensate level back to a normal operating level, the refrigeration system resets then returns to normal operation. However, the audible and visual indicators will remain energized until the refrigerated portions return to normal operating temperature.

Some embodiments of the present invention also comprise a moisture sensor located underneath or next to the condensate pan, or at a low point where leakage is likely to collect, to provide additional early leak detection. The moisture sensor allows for the detection of leakage from somewhere in a refrigerated case, such as from internal piping or other water boundaries associated with the case. The moisture sensor sends a signal to the control system, computerized or otherwise, causing visual and audible alarms to energize. In some embodiments, in response to a moisture alarm, the control system shuts down the compressor, energizes or keeps energized the condenser fan, and energizes the one or more condensate pan heaters. Other embodiments utilizing the moisture sensor may shut down all compressors, heaters, and fans when the sensor detects moisture but still energizes the visual and audible indicators and sends a signal to the central control system.

In some embodiments of the present invention, a high-volume pump is utilized to eliminate the condensate. The pump can pump condensate up to a 45-foot vertical rise and to a virtually unlimited horizontal run. The use of a pump allows for the use of piping or flexible tubing that can be routed through a given space to the nearest drain. The advantages of using this method are it provides the lowest possible energy consumption and it has the lowest level of regular maintenance required to operate the system. Such a system is appropriate for high humidity locations and floral applications.

In other embodiments, a wicking dissipater is used to aid in the removal of condensate. The wick is a high efficiency wicking element that remains in contact with the bottom of a condensate tray. The waste air from the condensing unit is ducted through the wicking element to evaporate the absorbed condensate. When tested, a refrigeration system using a wicking dissipater was able to eliminate all of the condensate generated by the refrigerator within a controlled test environment of 75 degrees F. and 55% relative humidity. In some embodiments that use a wicking dissipater, a heating element is also implemented to ensure that all condensate is removed during temporary "out-of-normal" operating environments. A mold and mildew inhibitor solution dispenser may be implemented to minimize or prevent the formation of mold and mildew in the wicking element and the condensate tray.

In yet other embodiments, a hot-gas loop dissipater is used to aid in the removal of condensate. This dissipater utilizes the refrigeration plumbing waste heat between the compressor and the condenser to heat the condensate in order to accelerate evaporation. The evaporation process may be amplified by creating layers of hot-gas loop plumbing within multiple levels of condensate holding trays to heat the condensate to aid in the evaporation process. The hot-gas loop dissipater may also be combined with the wicking dissipater to further accelerate the evaporation process. A heating element located in the condensate trays may also be implemented to handle temporary "out-of-normal" operating environments.

Some embodiments of the present invention combine the features of other embodiments, such as a system comprising a shroud assembly for directing air flow through the condensate area, a wicking element, one or more condensate pan heaters, a hot loop dissipater, computerized controls with networking capabilities, condensate pan level sensors, a mold and mildew inhibitor system, and an ELD system.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which.

DETAILED DESCRIPTION

Figure 1:
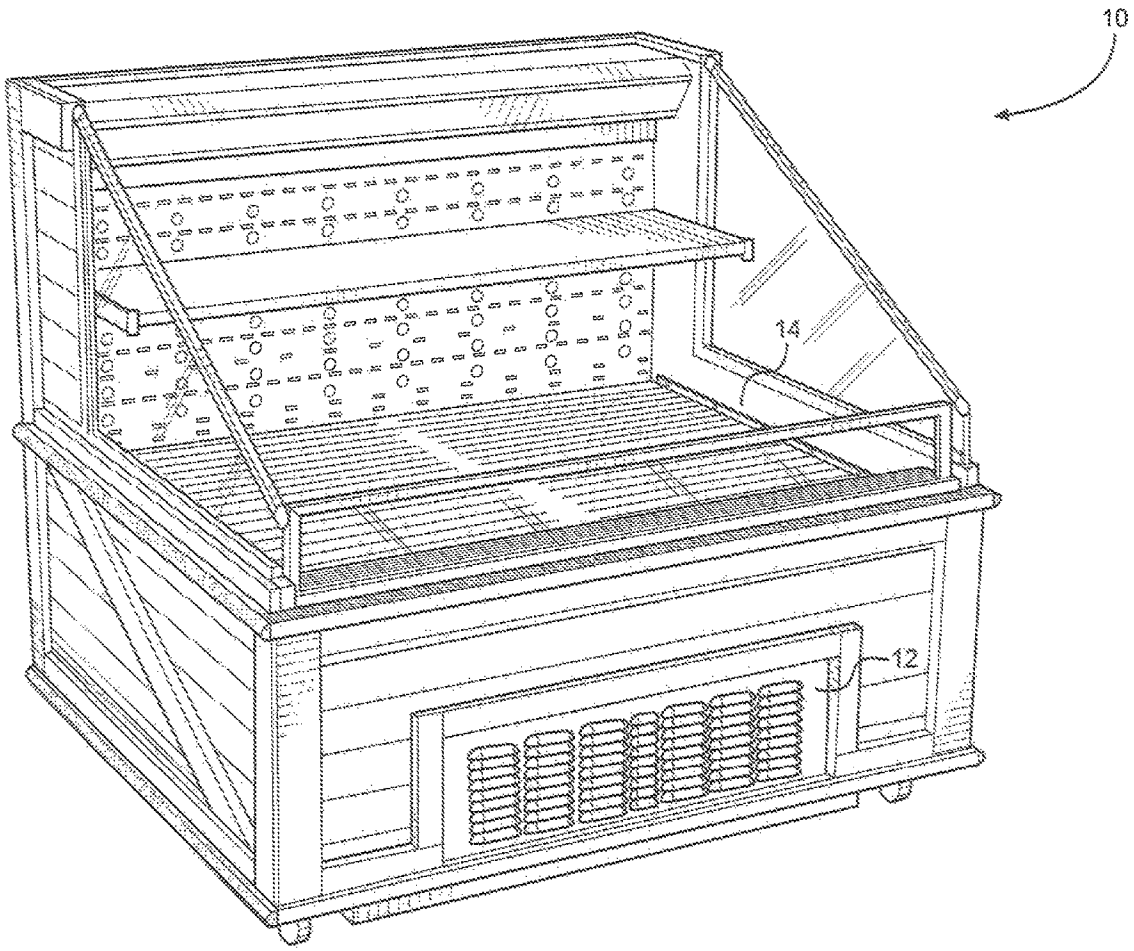
FIG. 1 is a perspective view of the front of a portable and self-contained refrigerated display case.

Referring initially to FIG. 1, a perspective view of the front of a portable and self-contained refrigerated display case is shown and referred to as 10. Refrigerated case 10 has a refrigerated space 14 that is cooled by the refrigeration system 20 (not shown, see FIG. 2) Located on the front of the refrigerated case 10 is air inlet cover 12 that allows cool air to enter the interior of the refrigerated case 10 to cool the refrigeration system 20. Air inlet cover 12 may also consist of air filters to prevent dirt and dust from entering the interior of refrigerated case 10, which may reduce air flow through the system thereby reducing efficiency and increasing total power usage.

Figure 2:
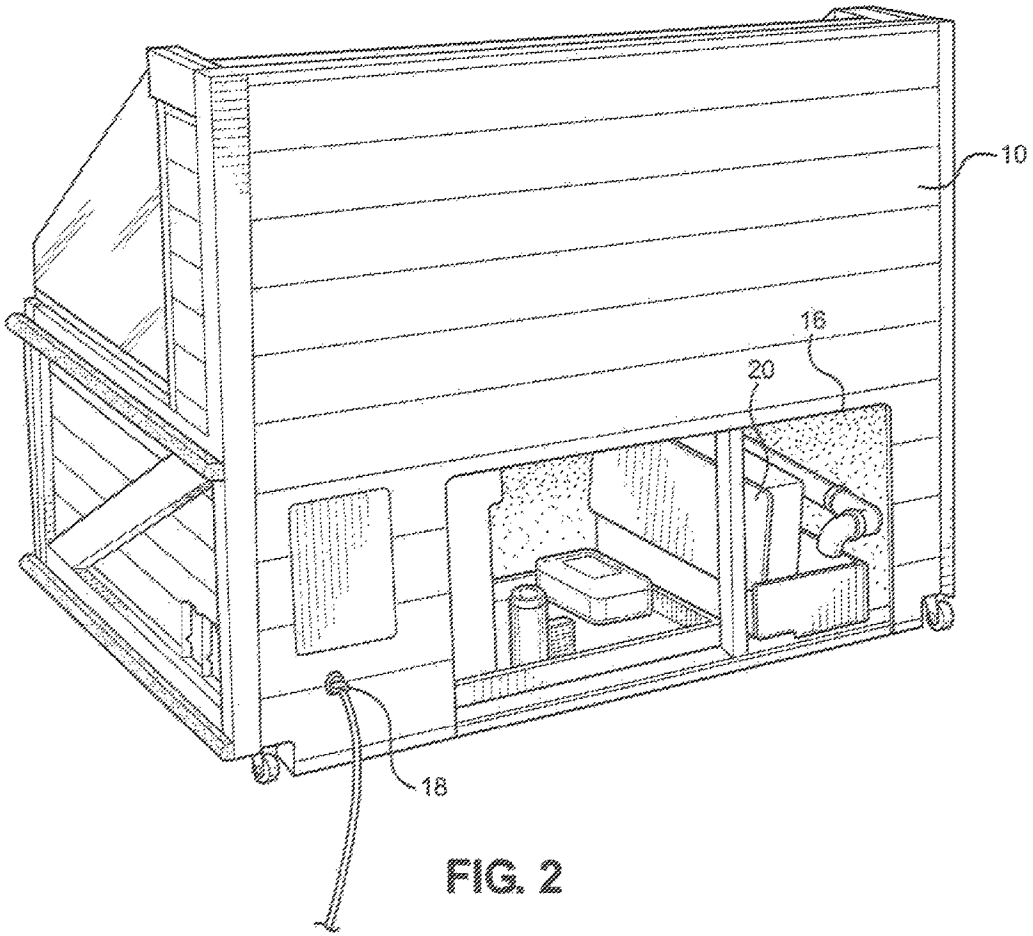
FIG. 2 is a perspective view of the rear of a portable and self-contained refrigerated display case showing the refrigeration unit.

Referring now to FIG. 2, a perspective view of the rear of refrigerated case 10 is shown. Located at the rear of refrigerated case 10 are power cord 18, air outlet 16, and refrigeration system 20. Power cord 18 may be configured to connect to various power systems, such as systems that supply power at 110 volts or 220 volts. It is to be appreciated by someone skilled in the art that refrigerated case 10 may be connected to most single phase power systems. Air outlet cover 24 (not shown) covers air outlet 16 and allows air flow generated by refrigeration system 20 to exit the interior of refrigerated case 10 to remove heat and humidity. When installed, air outlet cover helps to direct air flow through refrigeration system 20 such that the air flow assists in removing condensate and waste heat. Refrigeration system 20 will be discussed in more detail below.

Figure 3:
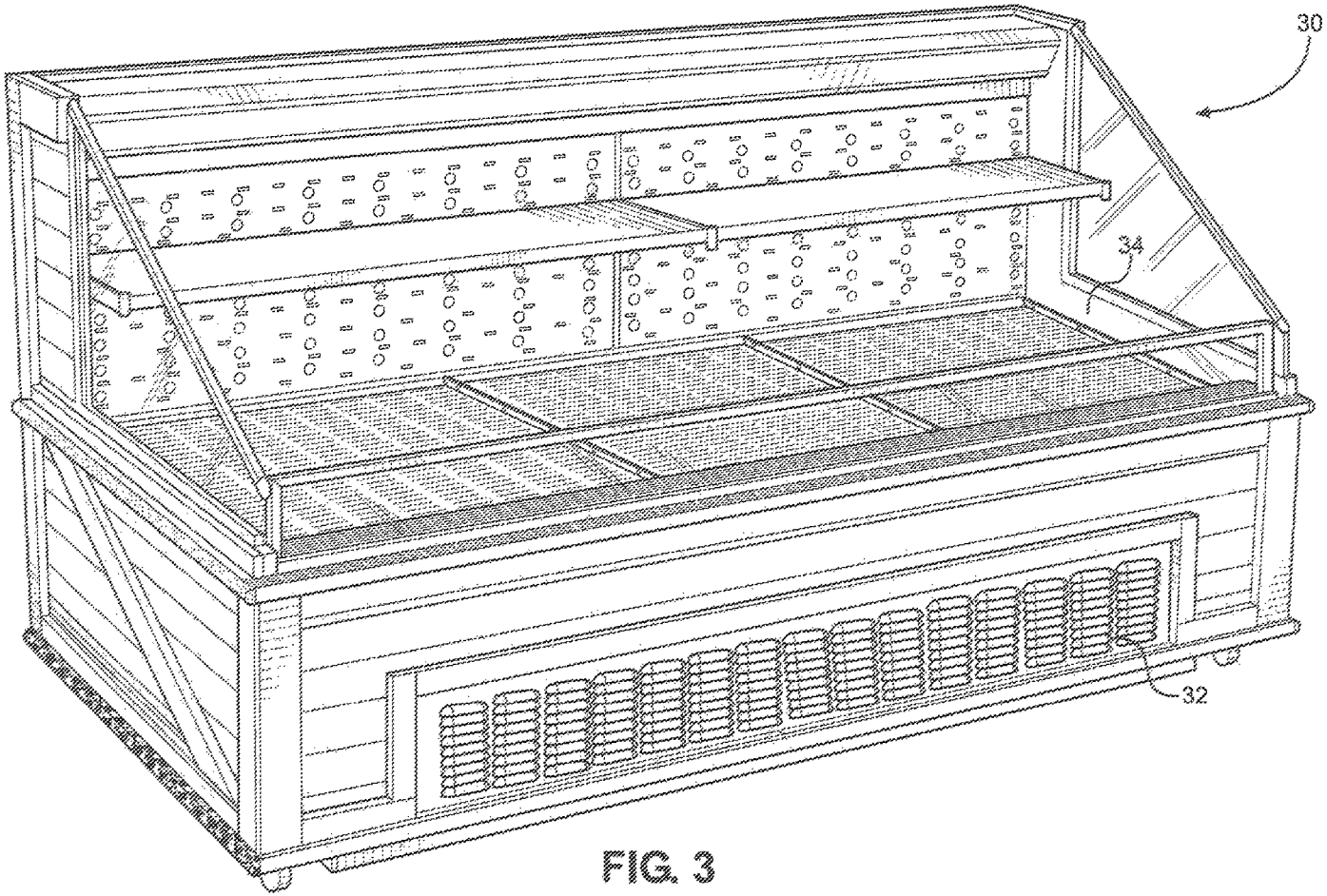
FIG. 3 is a perspective view of the front of a double wide portable and self-contained refrigerated display case.

FIG. 3 is a perspective view of the front of a double wide portable and self-contained refrigerated display case and referred to as 30. Similar to refrigerated case 10, refrigerated case 30 consists of air net cover 32 and refrigerated space 34. Similar to air net cover 12, air net cover 32 may also consist of air filters to remove dust and dirt from the air that enters the interior of refrigerated case 30 for waste heat and condensate removal.

Figure 4:
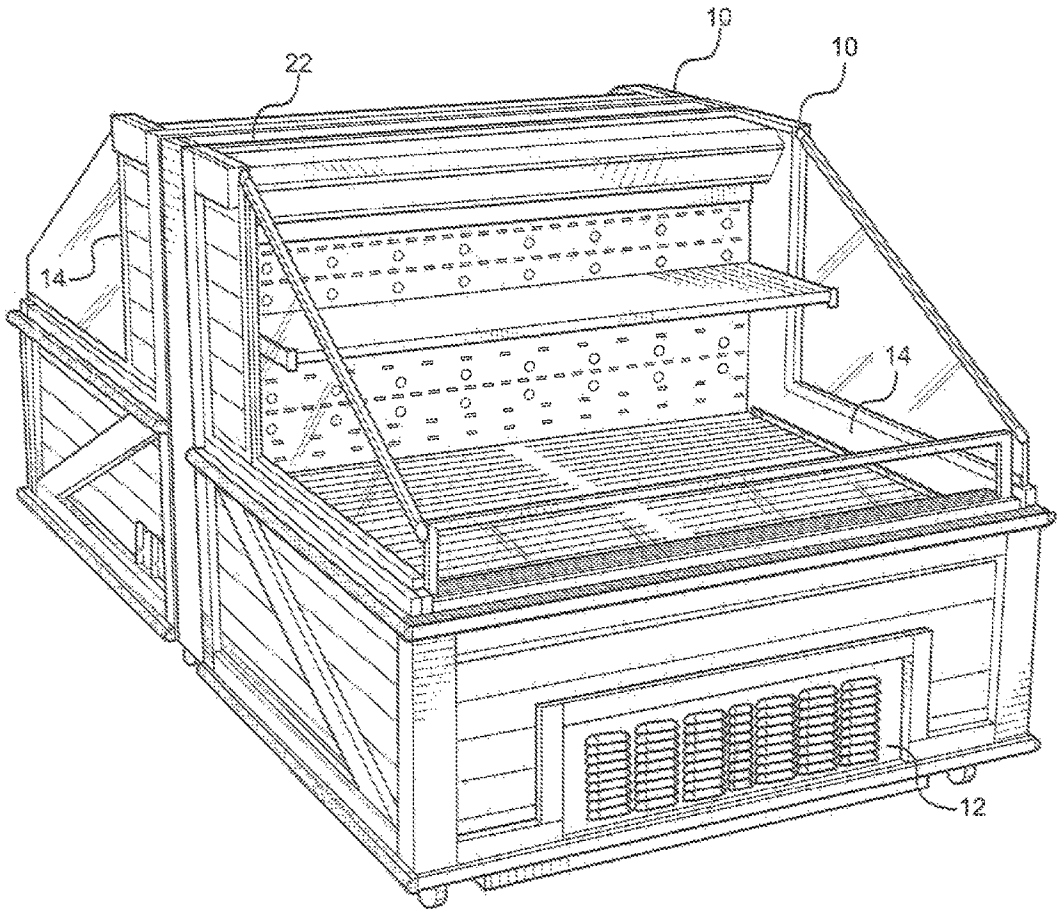
FIG. 4 is a perspective view of two refrigerated display cases oriented back to back having a spacer between the units to allow for moisture and heat removal.

FIG. 4 is a perspective view of two refrigerated cases 10 positioned back to back. Spacer 22 is a component that prevents the backs of the refrigeration cases from coming into contact with each other, thereby providing an air gap to allow waste heat and evaporated condensate from the refrigeration cases 10 to discharge into the ambient environment. A similar spacer may be used with doublewide refrigeration cases when placed back to back.

Figure 5:
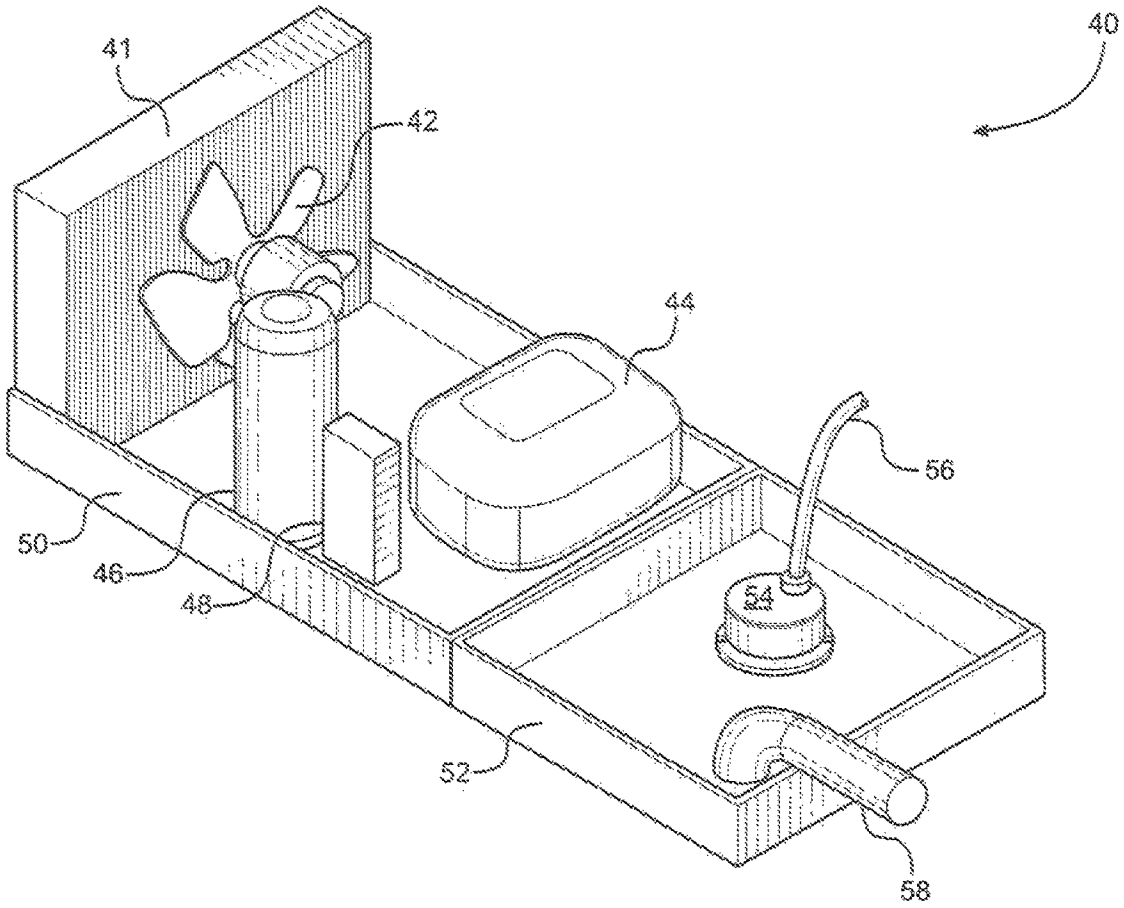
FIG. 5 is a schematic view of a refrigeration system the utilizes a high-volume pump to remove condensate.

FIG. 5 is a schematic view of a refrigeration system that utilizes a high-volume pump to remove condensate and is referred to as 40. Refrigeration system 40 consists of a condenser 41, a fan 42, a compressor 44, an accumulator 46, a controller 48, a pan 50, a condensate tray 52, a high volume pump 54, a discharge hose 56, and a condensate drain 58. Condenser 41, fan 42, compressor 44, accumulator 436, and controller 48 function using a typical refrigeration cycle. Compressor 44 forces hot gas into condenser 41, which fan 42 moves air through to remove heat. Condenser 41 allows the hot gas to condense into a high-pressure hot liquid that is then pumped through an expansion valve where the pressure and temperature of the hot liquid is reduced. The low-pressure liquid then moves through the evaporator where it expands back into a low pressure gas thereby causing the temperature of the gas to decrease as a result of the gas expansion. The hot low pressure gas then flows to the accumulator then to the compressor where it becomes a high pressure gas ready to flow in the condenser where it returns to being a high pressure liquid and the refrigeration cycle repeats itself. Controller 48 controls the overall operation of refrigerated cases 10 and 30, including the operation of compressor 44, fan 42, and any heating elements 62 (see FIG. 6). Controller 48 may also allow multiple refrigerated cases to be networked together to allow a central monitoring and control system (see FIGS. 10-12) to monitor and control the operation of the individual cases. Some embodiments of the present invention may, for instance, implement a level sensor 63 (see FIG. 7) in condensate tray 52. If the level of condensate exceeds a predetermined level, a local maintenance light (not shown) and an audible indicator may be activated as well as the central system is notified so maintenance may be performed on the refrigerated case. Other information may be reported to the central system such as local system status, power usage, and temperatures. Other embodiments may include Wi-Fi technology (see FIGS. 11-12) to allow networking of the refrigerated cases without the need to install network cables throughout the space.

High volume pump 54 is used to pump condensate from the condensate tray 52. Condensate is produced by the evaporator coil located in refrigerated spaces 14 and 34. The condensate tpically drips off the coils of the evaporator where it is collected and directed to condensate tray 52 through condensate drain 58. During normal operation in a high humidity location or a floral refrigeration system, the amount of condensate produced may exceed traditional methods of condensate removal, such as boiling off the condensate using a heating element. The failure to remove all produced condensate results in ongoing and routine maintenance that removes the collected condensate and may lead to the formation of mold and mildew. The use of high volume pump 54 allows the use of flexible hose or tubing 56 to direct the condensate out of refrigerated cases 10 and 30 to a location having a drain. Pump 54 provides sufficient output pressure that the condensate can be pumped up to a height above the refrigeration case then horizontally to an appropriate drain location. Since flexible hose or tubing 56 is used, the hose or tubing 56 may be routed as necessary to reach the drain location. Such an implementation allows refrigerated cases 10 and 30 to be placed a various locations in a store without the need to consider where to drain the condensate since the hose or tubing 56 is flexible and may be routed as necessary. In an alternative embodiment, refrigeration system 40 may also consist of a heating element 62 (not shown, see FIG. 6) to aid in condensate removal as well as to heat the condensate on a periodic basis to help kill or reduce mold and mildew.

Figure 6:
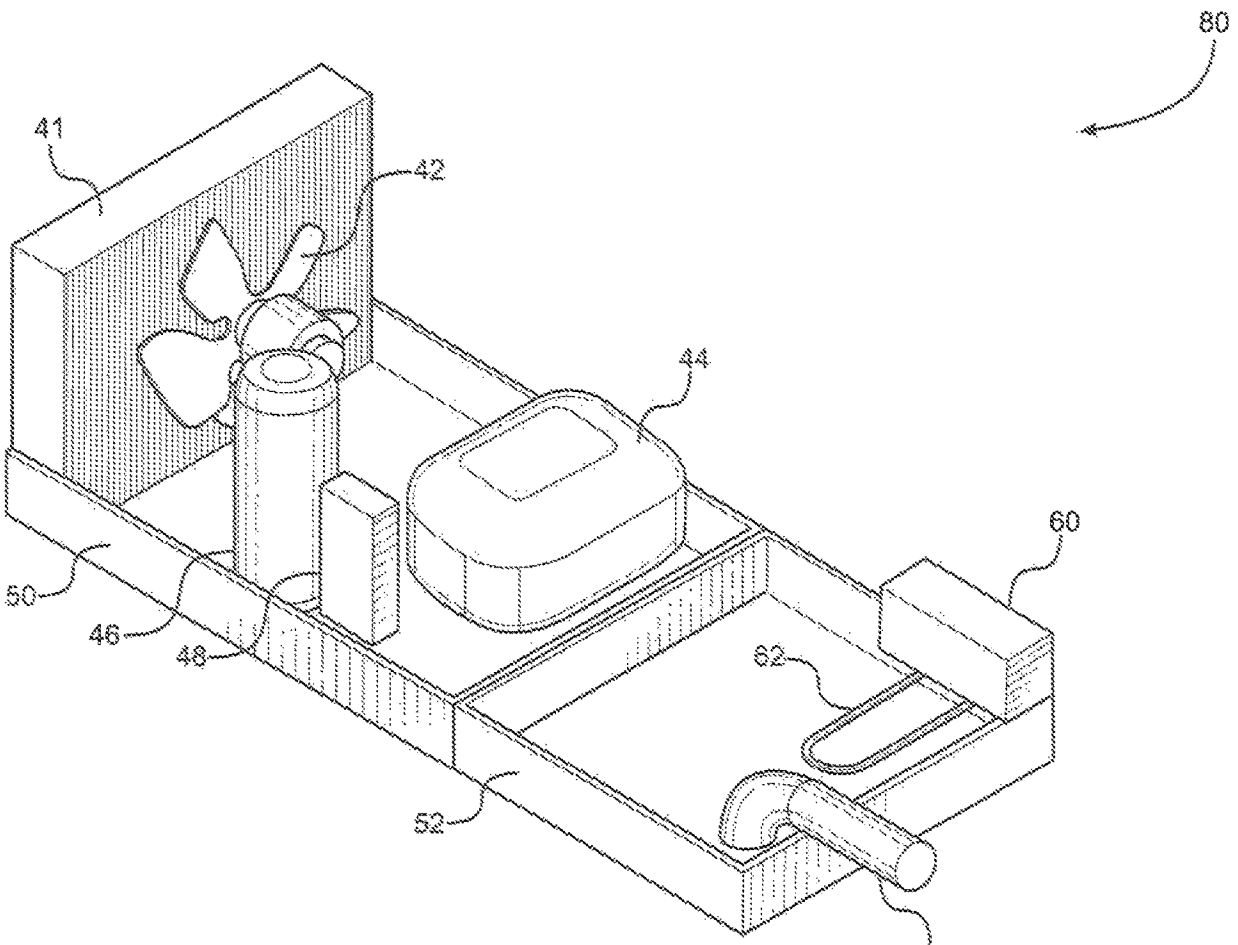
FIG. 6 is a schematic view of a refrigeration system that utilizes a heating element to boil off condensate that collects in the condensate tray.

Referring now to FIG. 6, a schematic view of a refrigeration system utilizing a heating element to remove condensate is shown and referred to as 80. Refrigeration system 80, similar to refrigeration system 40, consists of a condenser 41, a fan 42, a compressor 44, an accumulator 46, a controller 48, a pan 50, a condensate tray 52, a heat controller 60, a heating element 62, and a condensate drain 58. Some embodiments may use a shroud 68 (see FIG. 7) to direct airflow through the refrigerated cases 10 and 30. The operation of refrigeration system 80 is similar to refrigeration system 40 except for the method of condensate removal. In operation, refrigeration system 80 will run for an extended period of time to cool refrigerated spaces 14 and 34. After running for the extended period of time, compressor 44 and fan 42 will turn off thereby reducing power demand. Next, heat controller 60 energizes heating element 62 to boil off any condensate that has accumulated in condensate tray 52. The amount of time that heating element 62 is energized depends on the ambient temperature and the amount of condensate that has collected in condensate tray 52. In some embodiments of the present invention, a liquid level sensor 63 (not shown, see FIG. 7) is utilized to determine proper timing for the cooling and defrost cycles. Since the items located in refrigerated spaces 14 and 34 must be kept at a certain temperature, the amount of time available to operate heating element 62 may be limited. As such, heating element 62 may be powerful enough that additional power connections or higher input voltages to the refrigerated cases 10 and 30 may be necessary. However, the use of more powerful heaters may result in the total power consumed by the systems to exceed power efficiency guidelines.

Figure 7:
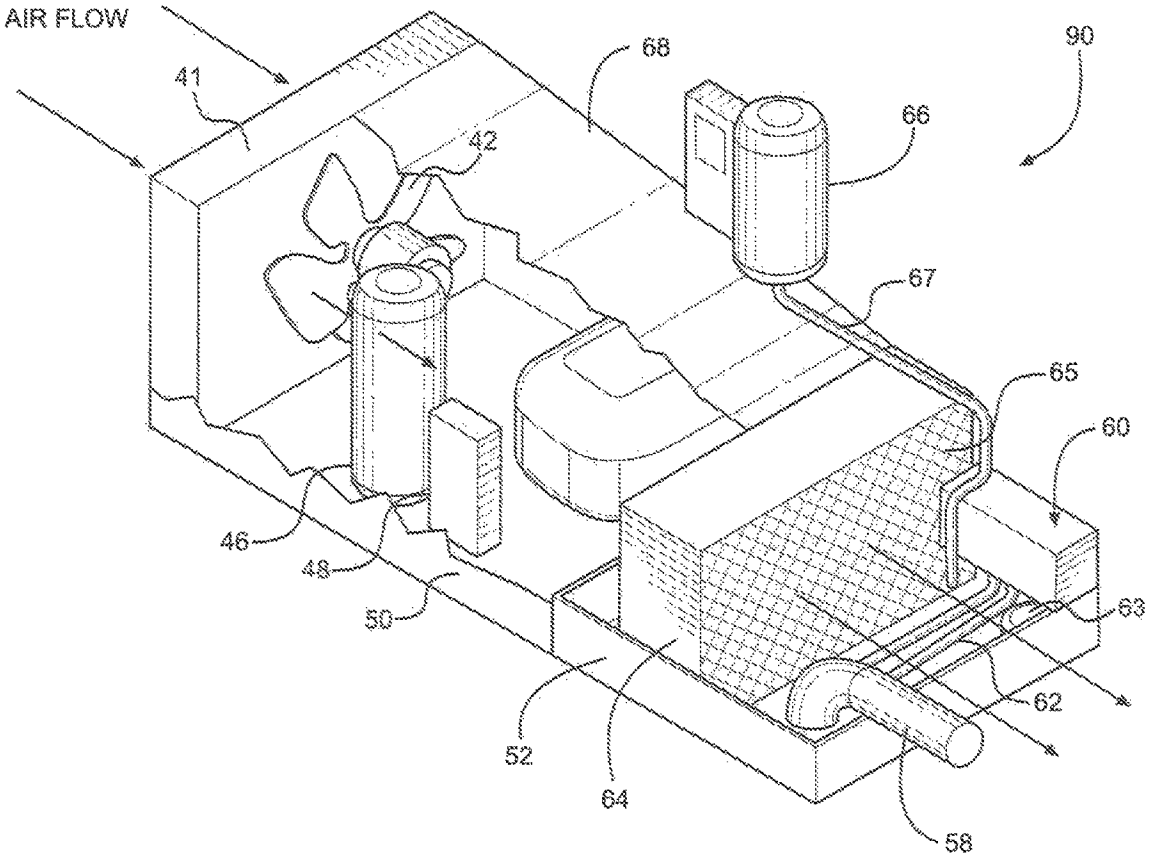
FIG. 7 is a schematic view of a refrigeration system that utilizes a heating element, a wicking element, and a shroud that directs air flow from the condenser through the wicking element to evaporate condensate.

FIG. 7 is a schematic view of a preferred embodiment refrigeration system of the present invention and referred to as 90. Refrigeration system 90 consists of a condenser 41, a fan 42, a compressor 44, an accumulator 46, a controller 48, a pan 50, a condensate tray 52, a heat controller 60, a heating element 62, a level sensor 63, an evaporative wick 64, a shroud 68, and a condensate drain 58. Wick 64 is located in condensate pan 52 such that the bottom of wick 64 conies into contact with condensate that collects in condensate pan 52. Due to the wicking action of wick 64, condensate wicks up into the structure of wick 64. Wick 64 is designed with horizontal airflow passages 65 that allow air to flow through the structure of wick 64. During operation of a typical refrigeration cycle, an appreciable amount of waste heat is generated, particularly in the condenser 41.

To aid in condensate removal, the airflow generated by fan 42 is ducted by shroud 68 through condenser 41 to wick 64, where the air passes through airflow passages 65 which run horizontally through wick 64. The airflow through airflow passages 65 of wick 64 evaporates condensate absorbed by wick 64. In a preferred embodiment, the wick 64 may be made by any material known in the art to exhibit wicking properties including capillary action, including but not limited to silica, polyester, Teflon, and other synthetic materials. Also, many natural materials, such as rayon cellulose, cotton and wool, are suitable materials for acceptable wicking propeities for the present invention. Wick 64 includes air passages which run horizontally through the body of the wick 64 to facilitate the exposure of the wetted wicking material to the air as it passes through the wick 64. The particular size and shape of the wick passages 65 as shown in FIG. 7 are merely exemplary. It is to be appreciated that the specific size, shape, and configuration of the wick passages 65 are merely exemplary, and are in no way intended to limit the scope of the invention. Rather, all wicking materials and configurations known in the art are fully contemplated herein. While it is advantageous to provide a wick 64 having distinct passages 65, it is also contemplated that wick 64 may be formed with a variable mesh configuration in which there is no clearly formed passage through the wick 64, yet air passes through at least a portion of it.

The increased temperature of the airflow, resulting from the heat given off by condenser 41, increases the rate of condensate evaporation. After the airflow exits wick 64, the airflow exits the rear of refrigerated cases 10 and 30 through air outlet 16 in air outlet cover 24. In certain embodiments of the present invention, air outlet cover 24 provides a portion of shroud 68 to direct airflow to wick 64. This design also allows for quicker and easier access to the refrigeration components during maintenance. Fan 42 may be configured to operate when compressor 44 is deactivated, thereby allowing fan 42 to continue generating air flow through wick 64 to continue removing condensate.

Refrigeration system 90, similar to refrigeration system 80, utilizes heat controller 60, level sensor 63, and heating element 62. Heating element 62 can be used to supplement the condensate removal effect of wick 64. Heating element 62 also aids in the prevention of mold and mildew by periodically energizing heating element 62 to raise the temperature of any standing condensate in condensate tray 52 to an appropriate level to kill mold, mildew, and any other bacteria that may exist in the condensate. Since refrigeration system 90 utilizes waste heat to aid in the removal of condensate, the amount of time and power used by heating element 62 is greatly reduced thereby reducing the overall amount of power consumed by refrigeration system 90. Further, since the overall power requirements are reduced, standard power connections may be used to operate the systems without the need for additional power connections or high voltage connections. Such power reductions allow refrigerated cases 10 and 30 to operate within established guidelines for power consumption and efficiency.

In certain embodiments of the present invention, a dispenser 66 and dispenser tube 67 are utzed to allow for the addition of a mold and mildew inhibitor solution to the condensate. Since wick 64 will also absorb the inhibitor solution along with the condensate, mold and mildew will also be prevented within the structure of wick 64. As discussed above, heating element 62 may also be energized on a periodic basis, or as needed, to aid in the prevention of mold and mildew in condensate tray 52 and wick 64. The prevention of mold and mildew is especially critical in the grocery business due to the offensive nature of the odors produced by molds and mildews. Since refrigerated cases 10 and 30 take in and expel air, any mold or mildew smells generated within the cases 10 and 30 will be spread throughout the store.

Figure 8:
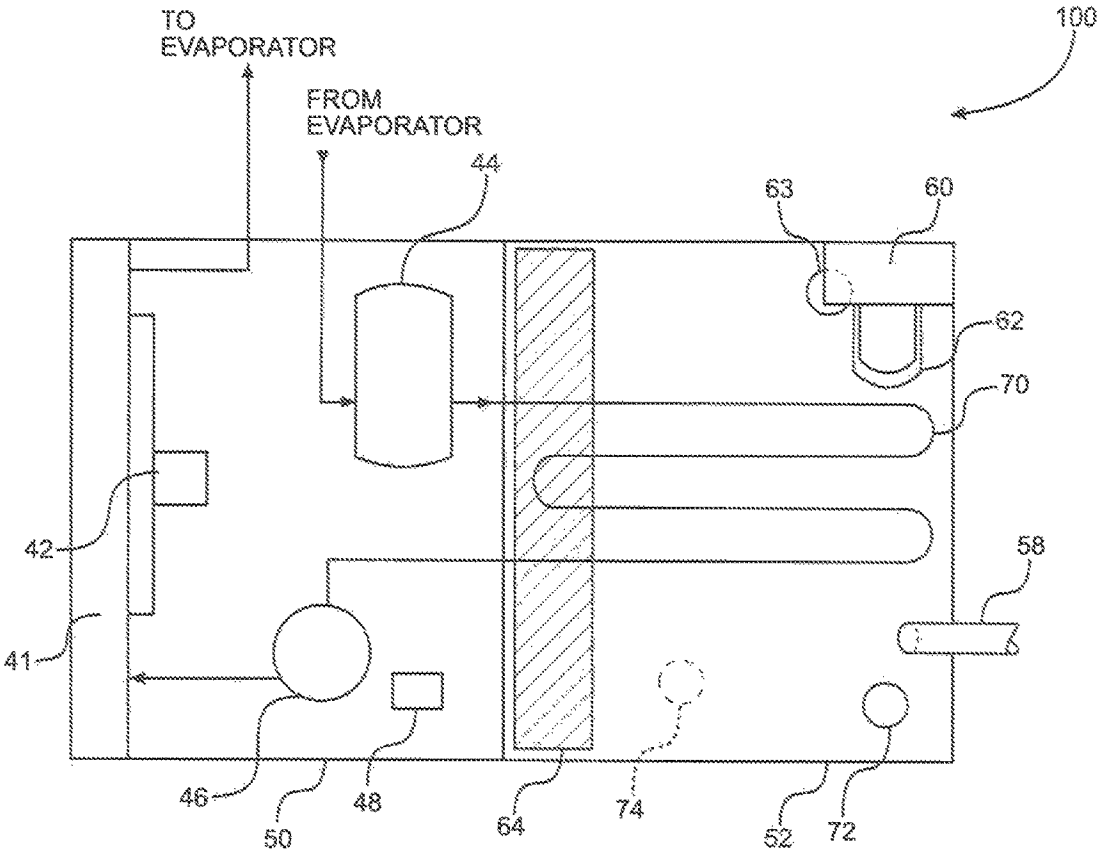
FIG. 8 is a schematic view of a refrigeration system that utilizes the hot gas portion of the refrigerant system that pre-heats the condensate to aid in condensate removal.

FIG. 8 is a schematic view of a refrigeration system that utilizes the hot gas portion of the refrigerant cycle to aid in the removal of condensate and is referred to as 100. Refrigeration system 100 consists of a condenser 41, a fan 42, a compressor 44, an accumulator 46, a controller 48, a pan 50, a condensate tray 52, a heat controller 60, a heating element 62, and a condensate drain 58. As discussed above, in a refrigerant cycle, hot high-pressure gas is created by compressor 44. Typically, the heat from the hot high-pressure gas is transferred to the ambient air as waste heat through the condenser 41. In this embodiment of the present invention, hot gas tube 70 is routed such that it makes one or more loops in the bottom of condensate tray 52. Certain embodiments may contain condensate trays having multiple levels so that hot gas tube 70 makes mudtiple loops through each level of the condensate tray thereby increasing the efficiency of the system since more heat will be transferred from hot gas tube 70 to the condensate.

In operation, any condensate that collects in condensate tray 52 through condensate drain 58 is heated by the waste heat transferred from hot gas tube 70, thereby increasing the rate of evaporation. Since hot gas is generated at all times during operation of compressor 44, waste heat is continually transferred to any condensate accumulated in condensate tray 52. As a result, the amount of time required for heating element 62 to operate is reduced, if not eliminated. This use of waste heat to evaporate condensate and reduced run time for heating element 62 allows refrigerated cases 10 and 30 to operate within prescribed energy consumption limits.

Also shown in FIG. 8, are early leak detection system and a moisture sensing system. Early leak detection system comprises an early leak detector (ELD) 72, which comprises at least one level sensor positioned in the condensate tray 52. If a multilevel condensate tray is used, the ELD 72 is located in the bottom most level. In contrast to the operation of level sensor 63 (see FIG. 7), ELD 72 is configured to sense condensate level at or near the top of the condensate tray. In normal operation, level sensor 63 controls the timing for the cooling and defrost cycles. The main purpose of ELD 72 is to sense condensate level near the top of condensate tray 52. Due to the desire to avoid slip and fail type accidents, ELD 72 is configured to cause refrigeration system 100 to shut-down thereby stopping the creation of condensate. If the condensate level reaches a predetermined level, ELD 72 sends a signal to refrigeration system 100, which in response turns off the compressor 44 and fan 42. Certain embodiments of the present invention has the refrigeration system 100 only turning off compressor 44 while leaving fan 42 energized to assist in the reduction of condensate level in condensate tray 52 in response to a signal from the ELD 72. It is to be appreciated by someone skilled in the art that ELD 72 may be used in other embodiments of the present invention.

Also shown in FIG. 8, is moisture sensor 74. Moisture sensor 74 is located at a low point in refrigerated cases 10 and 30 where water or moisture is likely to accumulate. In a preferred embodiment, moisture sensor 74 is located below condensate tray 52. However, alternative embodiments of the present invention may have moisture sensor 74 located away from refrigeration system 100. Moisture sensor 74 is configured to sense the present of moisture, not just the presence of standing liquid. Since moisture sensor 74 is located outside of condensate tray 52, it should not sense the presence of any moisture. However, due to differing operating conditions, moisture sensor 74 may be configured to sense some moisture without generating an alarm condition.

The presence of moisture inside refrigerated cases 10 and 30 may lead to the formation of mold and mildew, which typically produces an offensive odor. Moisture sensor 74 provides an indication that moisture has formed outside of refrigeration system 100, which may be due to an overflow condition of condensate tray 52 or a leak from another portion of refrigerated cases 10 and 30.

Figure 9:
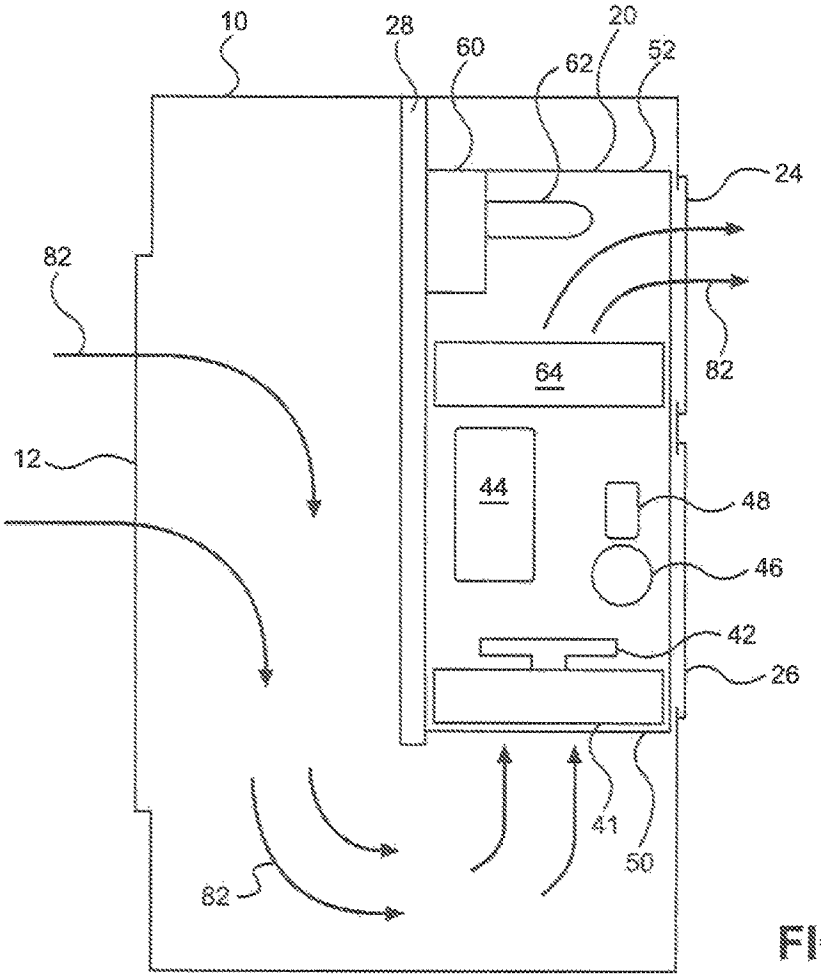
FIG. 9 is a top schematic view of a refrigerator case showing the airflow path through the case to allow for accelerated evaporation of condensate buildup.

Referring now to FIG. 9, shown is a top schematic view of the interior of a refrigerator case showing the airflow path through the refrigerator case. As shown, refrigerated case 10 contains refrigeration system 20, divider wall 28, air inlet cover 12, air outlet cover 24, and rear panel 26. Refrigeration system 20 consists of Condenser 41, fan 42, compressor 44, accumulator 46, and controller 48 located in pan 50. Also contained in refrigeration system 20 are condensate tray 52, heater controller 60, heater 62, and wick 64. It is to be appreciated by someone skilled in the art that the refrigeration systems described in FIGS. 5, 6, 7, and 8 may be used for refrigeration system 20 without departing from the scope and spirit of the present invention.

As shown in FIG. 9, airflow 82 enters the front of refrigerated case 10 through air inlet cover 12. The presence of divider wall 28 causes airflow 82 to divert around the divider wall 28 and enter the condenser 41 of refrigeration system 20. Airflow 82 then passes through the refrigeration system 20, where the airflow 82 removes heat created in a refrigeration cycle and aids in the removal of condensate that accumulates in condensate pan 52. A shroud, such as shroud 68 (not shown, see FIG. 7) may be used to further aid in the control of airflow 82. Airflow 82 then exits the refrigerated case 10 through air outlet cover 24. Rear panel 26 is a solid panel and does not let airflow 82 pass through it. Rear panel 26 allows for easy access to the portion of refrigeration system 20 contained in pan 50. During use, a system operator must install rear panel 26 to allow airflow 82 to properly move through refrigeration system 20.

It is to be appreciated by someone skilled in the art that different styles of refrigerated cases, such as double refrigerated case 30 (see FIG. 3), may be used alone or in conjunction with refrigerated cases 10 without departing from the scope and spirit of the present invention.

Figure 10:
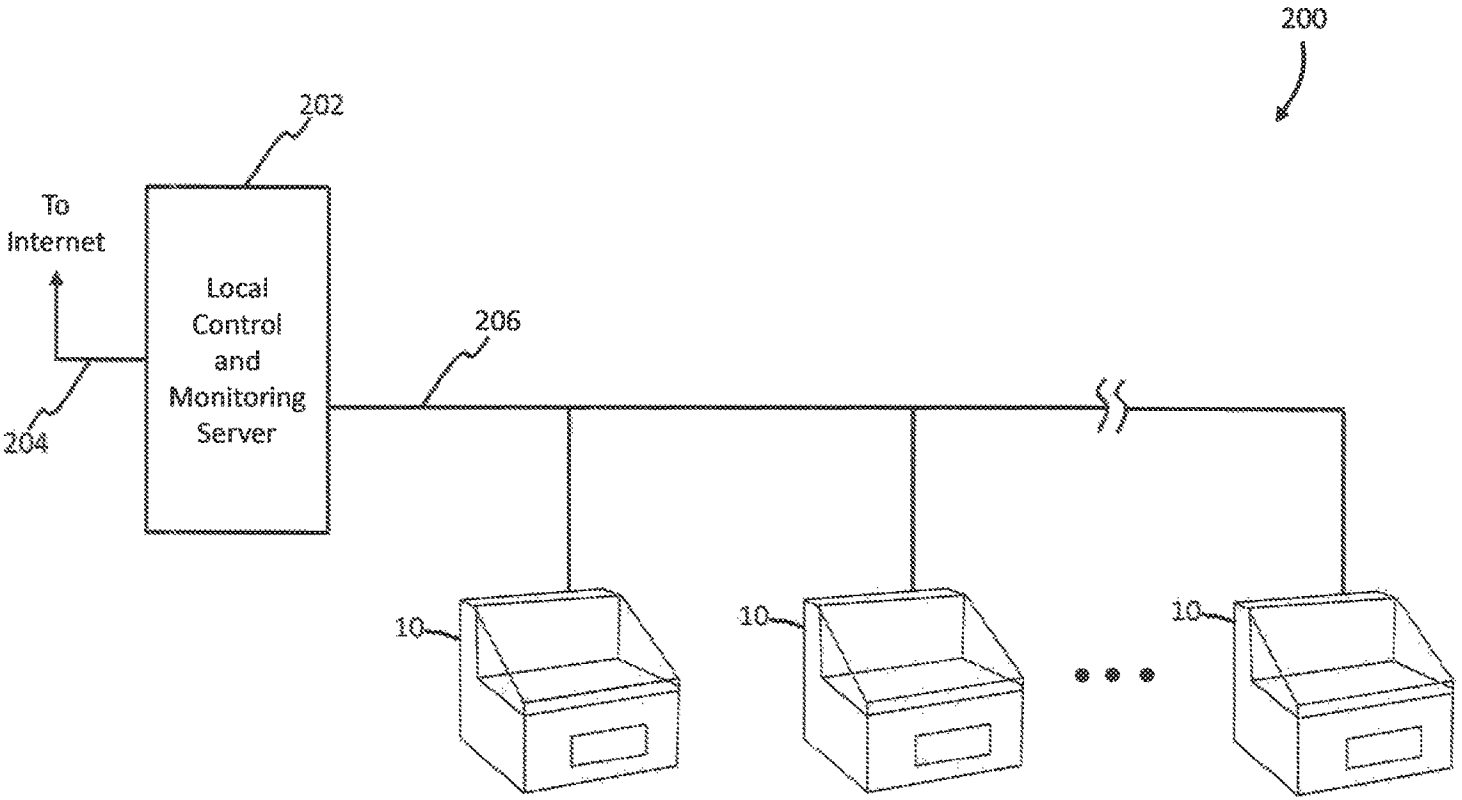
FIG. 10 is a schematic view of multiple refrigeration systems connected to a central control and monitoring system.

Referring now to FIG. 10, a system of refrigerated cases connected to a local control and monitoring system is shown and generally designated 200. System 200 comprises multiple refrigerated cases 10 connected to a local control and monitoring server 202 through local network 206. Server 202 may have an internet connection 204. Local network 206 connects to controller 48 (see FIGS. 5-8). Controller 48 is configured to communicate refrigerated case's 10 operational and status information to, as well as receive operational commands from, server 202. Server 202 is configured to receive information from each refrigerated case 10 and generate appropriate commands or notifications in response to the received information. For example, refrigerated case 10 may report to server 202 that the temperature of the refrigerated space 14 is too high to properly maintain the temperature of any items located in the space 14. Server 202 may then send a command signal to refrigerated case 10 to decrease its temperature setting. Alternatively, refrigerated case 10 may report to server 202 that condensate pan 52 is full and requires attention. Server 202 may then issue a notification about the condition of refrigerated case 10 to the appropriate person. Refrigerated case 10 may also report to server 202 the removal and replacement of covers 12, 24, and 26, and condensate tray 52.

Figure 11:
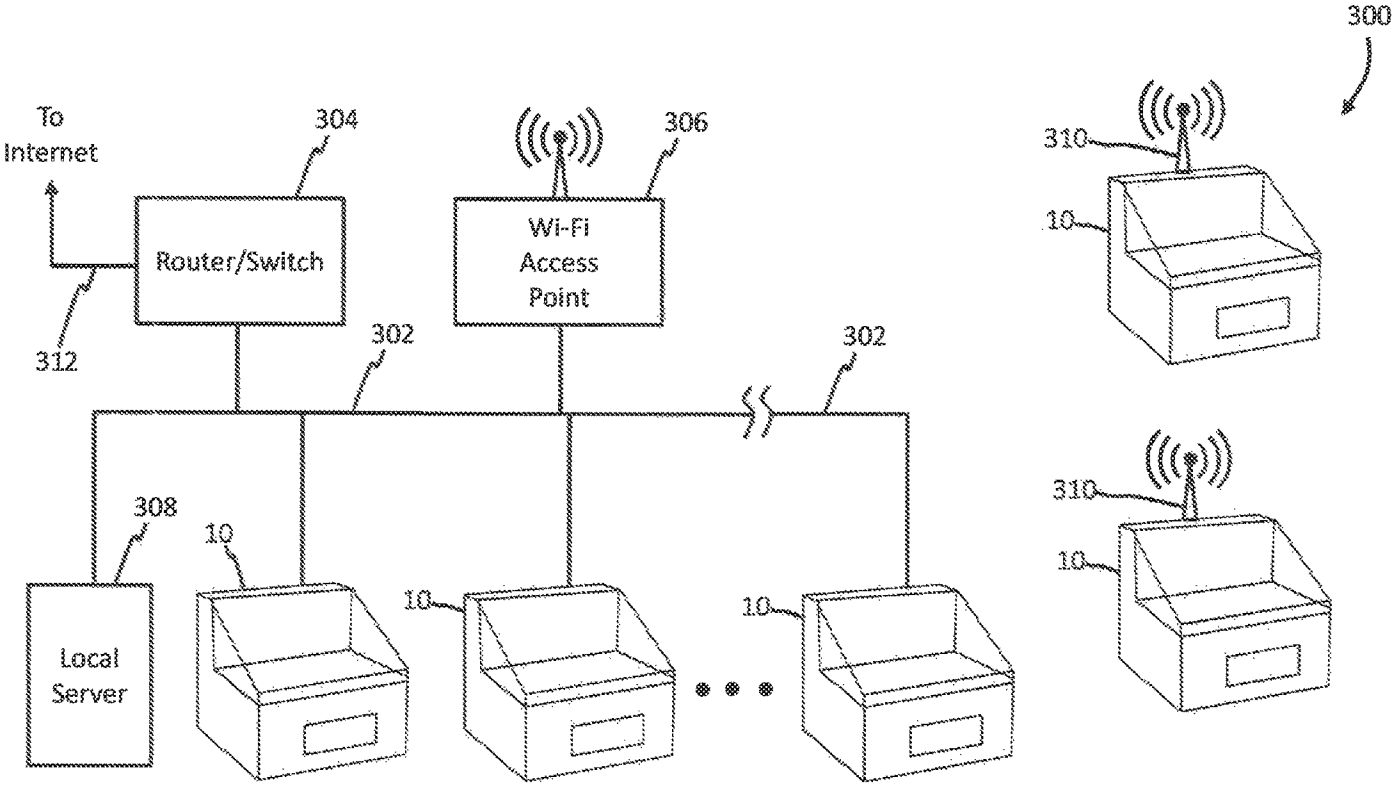
FIG. 11 is a schematic view of refrigeration systems that utilize hardwired and wireless networking to connect the refrigeration systems to the control and monitoring system.

FIG. 11 is a schematic view of a system of refrigerated cases connected to a local control and monitoring server through a hybrid wired and wireless local network and generally designated 300. System 300 comprises multiple refrigerated cases 10, a local control and monitoring server 308, a local network 302, a router/switch 304, a wireless access point 306, and a connection to the internet 312. As shown in FIG. 11, certain refrigerated cases 10 contain wireless transceivers 310, which are configured to communicate with wireless access point 306. Wireless access point 306 in turn communicates with server 308 through local network 302. Other refrigerated cases 10 are connected to local network 302 through hardwired connections. Local network 302 also connects to router/switch 304 to allow for external communications regarding the operational status of system 300.

In operation, refrigerated cases 10 communicate with local server to transmit case status as well as receive operational commands, similar to system 200 discussed above. Refrigerated cases 10 having the wireless transceiver 310 allow for easier placement of refrigerated cases 10 without the need to use a hardwire connection to local network 302. An operator may interface with server 308 to program temperature set points for each refrigerated case 10 collectively, individually, or in sub-groups.

Figure 12:
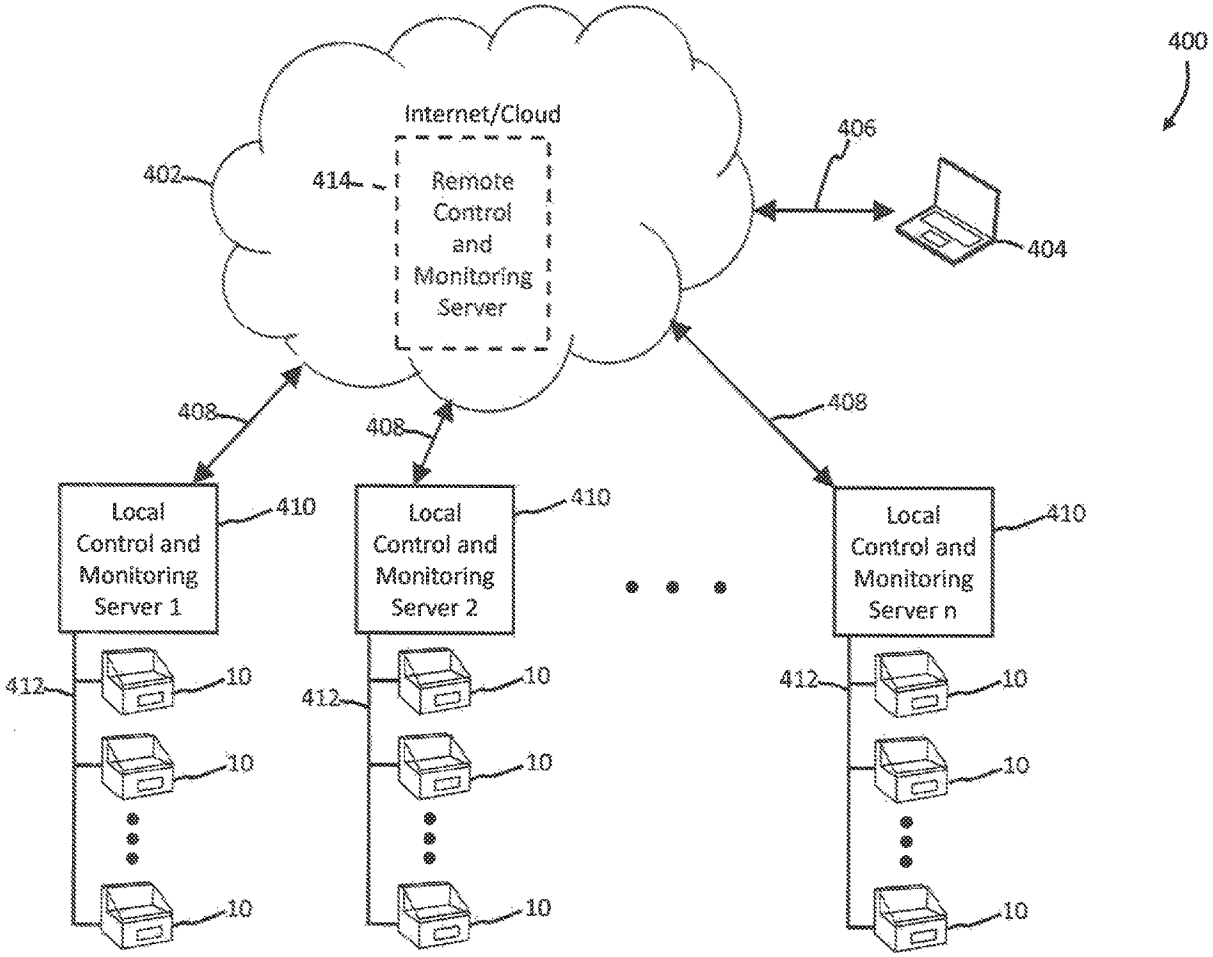
FIG. 12 is a schematic view of multiple control and monitoring systems connected to the internet/cloud, where each control and monitoring system has multiple refrigerated display cases connected to it through a local network and a remote operator able to connect using a remote terminal.

Moving now to FIG. 12, a schematic view of a system containing multiple control and monitoring systems connected to the internet/cloud is shown and generally designated 400. System 400 contains multiple local control and monitoring servers 410, with each server hosting refrigerated cases 10 connected through local network 412. It is to be appreciated by someone skilled in the art that refrigerated cases 10 and local network 412 may be the systems 200 and 300 described in FIGS. 10 and 11. However, other network topologies are fully contemplated.

Each server 410 connects to the internet/cloud 402 through communication link 408, which may be any type of connection including WAN, cellular, Ethernet, Frame Relay, Fiber Optic, or any other communication protocol known in the industry. Also connected to internet cloud 402 is remote computer 404, which connects to internet/cloud 402 through a communication link 406, which is any communication protocol known in the industry, similar to servers 410. An operator of remote computer 404 accesses each server 410 through internet/cloud 402 to receive status information and send operational commands, such as raising and lowering temperature set points for each refrigerated case 10.

Alternatively, a remote control and monitoring server 414 (shown in dashed ones) may be located in the internet/cloud 402, which communicates directly with local servers 410. In this configuration, remote server continually communicates with local servers 410 to send and receive status information and operational commands. The remote computer 404 then connects with remote server 414 to monitor status information and adjust desired set points or other features of system 400. In this alternative configuration, remote computer 404 may also connect directly to each local server 410 to send and receive status information and operational commands.

Local networks 206, 302, and 412 may be any type of networking topology known in the industry, such as Ethernet, RS232/422/485, wireless, or other point-to-point or multi-drop technology.

It is to be appreciated by someone skilled in the art that various portions of the various embodiments described above may be combined to create a more efficient system. For example but without limitation, refrigeration system 100 may also incorporate wick 64 and shroud 68 to create a system capable of operation in a high temperature and high humidity environment without the need for additional power connections, drains or the routing of tubing through the grocery space. Another example is dispenser 66 and dispenser tube 67 may be used with refrigeration systems 40, 80, and 100 without departing from the scope and spirit of the present invention. Further, since the above discussed systems are designed to remove condensate at an increased rate, maintenance requirements are minimized since accumulated condensate will not need to be removed manually.

While there have been shown what are presently considered to be preferred embodiments of the present invention, it will be apparent to those skilled in the art that various changes and modifications can be made herein without departing from the scope and spirit of the invention.

I claim:

1. A refrigerated case, comprising:

a refrigerated space;

an air inlet;

an air outlet;

a condensate collection tray configured to collect condensate from the refrigerated space;

a refrigeration system having a controller and configured to remove heat from the refrigerated space and remove the condensate from the condensate collection tray collected from the refrigerated space;

a condensate level detector located within the condensate collection tray and configured to measure a level of the condensate in the condensate collection tray and to generate a condensate level signal in response to a presence of the condensate at a predetermined condensate level in the condensate collection tray;

a means to remove the condensate from the condensate collection tray in communication with the condensate level detector, wherein the means to remove the condensate from the condensate collection tray is configured to remove the condensate upon detection of the condensate level signal;

a leak detector located at a high point of the condensate collection tray and configured to generate a high point signal in response to the presence of condensate at the high point of the condensate collection tray;

a condensate sensor located at a low point of the refrigerated case outside of said condensate collection tray and configured to generate a condensate detected signal in response to the presence of the condensate;

wherein the condensate level signal from the condensate level detector causes the means to remove the condensate from the condensate collection tray to turn on until the condensate level signal is no longer detected;

wherein the high point signal from the leak detector causes the refrigeration system to automatically shut down and turns on the means to remove the condensate from the condensate collection tray until the high point signal is no longer detected; and wherein the condensate detected signal from the condensate sensor causes the refrigeration system to automatically shut down until the condensate detected signal is no longer detected.

2. The refrigerated case of claim 1, wherein the refrigerated case further comprises an internal divider wall positioned to direct airflow from a side of the refrigerated case, through the refrigeration system, and out another side of the refrigerated case.

3. The refrigerated case of claim 1, wherein the means to remove the condensate from the condensate collection tray in communication with the condensate level detector comprises a heating element located near the bottom of the condensate collection tray, the heating element connected to a heater controller.

4. The refrigerated case of claim 3, wherein the condensate level detector is in communication with the heater controller, the heater controller configured to energize and de-energize the heater in response to the condensate level signal from the condensate level detector.

5. The refrigerated case of claim 1, wherein the means to remove the condensate from the condensate collection tray in communication with the condensate level detector comprises:

a fan;

a wicking element positioned in the condensate collection tray and configured to absorb the condensate and to allow air flow generated by the fan to pass through a plurality of airflow passages in the wicking element.

6. The refrigerated case of claim 1, the refrigeration system further comprising:

a condenser;

a compressor;

an accumulator;

a shroud configured to direct airflow through the refrigeration system; and a fan configured to move air through the condenser and across the condensate collection tray.

7. The refrigerated case of claim 6, further comprising a hot-gas loop dissipater configured to heat the condensate collected in the condensate collection tray.

8. The refrigerated case of claim 1, wherein the condensate level signal from the condensate level detector causes the controller to energize or keep energized a condenser fan.

9. The refrigerated case of claim 3, wherein the condensate level signal from the condensate level detector causes the controller to energize or keep energized the heating element.

10. The refrigerated case of claim 1, wherein the condensate detected signal from the condensate sensor further causes a visual and audible alarm to activate.

* * * * *